United States Patent [19]

Husson et al.

[11] 4,397,377

[45] Aug. 9, 1983

[54] ELEVATOR SYSTEM

[75] Inventors: Alan L. Husson, Hackettstown, N.J.; Jane B. Lanctot, St. Paul, Minn.

[73] Assignee: Westinghouse Electric Corp., Pittsburgh, Pa.

[21] Appl. No.: 286,149

[22] Filed: Jul. 23, 1981

[51] Int. Cl.[3] ..... B66B 5/02

[52] U.S. Cl. ..... 187/29 R

[58] Field of Search ..... 187/29

[56] References Cited

U.S. PATENT DOCUMENTS 2,695,077 11/1954 Suozzo ..... 187/29
3,854,554 12/1974 Booker, Jr. ..... 187/29
4,046,227 9/1977 Kirsch et al. ..... 187/29
4,162,719 7/1979 Husson et al. ..... 187/29

*Primary Examiner*—J. V. Truhe
*Assistant Examiner*—W. E. Duncanson, Jr.
*Attorney, Agent, or Firm*—D. R. Lackey

[57] ABSTRACT

An elevator system having a plurality of cars under group supervisory control by a programmable dispatcher. A monitor detects dispatcher failure via a plurality of tests which includes timing each hall call, and performing predetermined checks, tests and comparisons for each call related to actual system operating conditions.

28 Claims, 7 Drawing Figures

100
DMAB
DB0-7
BUFFERS
116
BUS CONTROLLER
110
CLOCK
112
WD0-11
D0-3
BUFFERS
118
D0-7
CPU
102
BUFFERS
108
A0-7
A0-9
A0-10
ROMS
104
RAMS
106
A8-15
DECODER
112
DECODER
114
A11-15
A10-15
DB0-7
11 SYSTEM PROCESSOR
INPUT INTERFACE
78
PROCESSOR
74
CORE MEMORY
72
EMT
RESETTABLE TIMER
689
10
INTERRUPT
80
TAPE READER
76
INTERFACE
70
OTHER CARS (B-F)
TIMING
82
EMT
CAR CONTROLLER & FLOOR SELECTOR
15
UPC
DNC
HALL CALL CONTROL
46
UPRZ
DNRZ
OTHER TIMING FUNCTIONS
MOTOR
20
42
PH
44
B2
40
SB-1
36
12
22
18
16
17
A
24
13
14

ELEVATOR SYSTEM

BACKGROUND OF THE INVENTION

1. Field of the Invention

The invention relates in general to elevator systems, and more specifically to elevator systems which include a plurality of elevator cars under the control of a system processor.

2. Description of the Prior Art

When a building requires a more than one elevator car to serve the traffic, some sort of supervisory control means is usually provided in order to insure efficient elevator service. For example, in U.S. Pat. No. 2,695,077 which is assigned to the same assignee as the present invention, the elevator cars are dispatched successively from a dispatching floor by a main dispatching device. Failure of the main dispatching device would terminate all elevator service once all of the elevator cars have returned to the main dispatching floor. Thus, this patent discloses the use of an emergency dispatching device, in order to continue elevator service.

U.S. Pat. No. 3,854,554, which is assigned to the same assignee as the present application, discloses an improved supervisory system control arrangement for a plurality of elevator cars, in which the cars are controlled by inhibit or overriding signals, rather than by direct commands. The elevator cars each include a car controller which enables the associated elevator car to independently respond to a registered hall call. The supervisory system control decides which elevator car should answer a specific hall call and issues signals which inhibit the other elevator cars from responding to the call. Failure of the supervisory control in a mode in which inhibit signals are not sent to the cars does not terminate elevator service, and it does not require a standby emergency dispatcher, as all elevator cars are automatically on independent control in the absence of inhibit signals.

Failure of the supervisory control in a mode which may continuously provide inhibit signals, or otherwise adversely affect the ability of the elevator cars to operate properly, may be detected by monitoring a selected function of the supervisory control. For example, when the supervisory system control includes a digital computer with the operating strategy stored in the memory thereof in the form of a program, the stored program must be run repeatedly to continuously update the systems. U.S. Pat. No. 3,854,554 suggests a hardwired timing circuit, as opposed to a software timing circuit, whose output is held high by periodic accessing by the stored operating program. Failure of the supervisory control to access the timing circuit at the proper frequency allows it to time out and provide a low signal which is used to prevent signals provided by the supervisory control from being considered by the car controllers of the various elevator cars.

U.S. Pat. No. 4,046,227 which is assigned to the same assignee as the present application, discloses a dispatcher monitor 230 which determines if the dispatcher is preparing timely command words for the elevator cars.

U.S. Pat. No. 4,162,719 which is assigned to the same assignee as the present application, discloses a dispatcher monitor which starts a timer when any hall call is registered, and it resets the timer when any hall call is reset. If the timer times out, corrective action is taken.

While these prior art monitoring arrangements detect certain dispatcher malfunctions, it has been found that certain dispatcher malfunctions may go undetected. For example, a certain portion of a program of a programmable system processor may be accessed on a timely basis, but if no cars are being dispatched by the system processor, there will be no elevator service. Since the monitor is detecting only whether or not the system processor is accessing a certain portion of the program on a timely basis, the monitor will not detect this failure. In like manner, the system processor may be providing command words for the elevator cars in a timely manner, but the word content of the commands may be incorrect, again resulting in either no elevator service, or degraded elevator service. A monitor which only checks to see whether command words are being provided in a timely manner, would not detect the quality of the commands. Still further, hass calls may be registered and hall calls may be reset, with no guarantee that all calls are being answered. Thus, a dispatcher monitor which operates on this basis may allow failure to serve certain floors to go undetected.

These prior art dispatcher monitors do not take system operating conditions into consideration when determining whether or not the dispatcher has malfunctioned. During certain system operating conditions, a hall call from a certain floor may normally take a longer period of time to be serviced. Thus, a monitor which generally compares call registration with call reset may needlessly shut the dispatcher down, unless the timing period is set quite long. Setting the timing period long, however, results in a long period of time without elevator service when the dispatcher does malfunction.

SUMMARY OF THE INVENTION

Briefly, the present invention is a new and improved elevator system having a plurality of cars under group supervisory control by a monitored programmable system processor or dispatcher. The dispatcher monitor monitors each registered call for elapsed registration time, to detect a dispatcher malfunction. The call registration times are compared with a static threshold to determine if the call has been registered long enough to merit further processing. Passing this initial test, certain dispatcher responses are tested against known conditions outside the dispatcher. Failure of these tests results in the monitor initiating corrective action. Certain system traffic conditions are also checked for traffic peaks to determine if the monitoring of the call in question should continue, considering such call parameters as the call service direction, and the location of the call floor in the building. A call which passes all of these threshold and traffic condition tests is then compared with a dynamic call registration time threshold, with this dynamic threshold being determined by the monitor according to the number of in-service elevator cars capable of serving the monitored call. If the call registration time exceeds the dynamic threshold, the monitor resets the dispatcher, if this malfunction is the first malfunction within a predetermined period of time. If a prior malfunction occurred within the predetermined period of time, the elevator cars are removed from dispatcher control and allowed to operate independently upon the strategy built into their car controllers and the hardwired hall call distribution system.

BRIEF DESCRIPTION OF THE DRAWING

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

Figure 1:
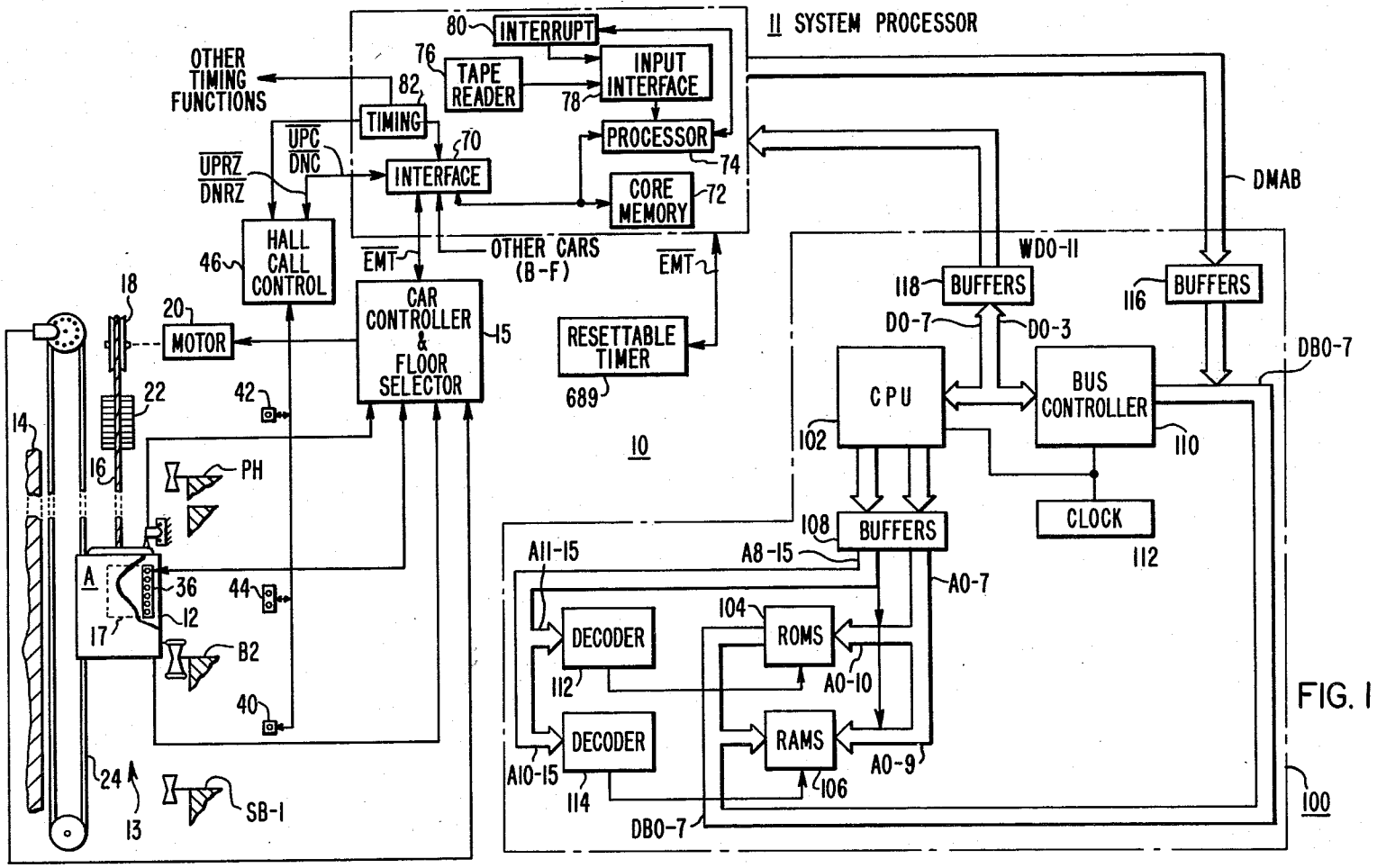
FIG. 1 is a partially schematic and partially block diagram of an elevator system constructed according to the teachings of the invention.

Referring now to the drawings, and to FIG. 1 in particular, there is shown an elevator system 10 constructed according to the teachings of the invention. In order to limit the length and complexity of the present application, it will be assumed that an elevator system collectively set forth in U.S. Pat. Nos. 3,750,850; 3,804,209; and 3,851,733, which are assigned to the same assignee as the present application, is modified according to the teachings of the invention. Accordingly, these U.S. patents are hereby incorporated into the present application by reference.

U.S. Pat. No. 3,750,850 discloses elevator control suitable for operating a single elevator car. The hall call answering strategy of this control causes the associated elevator car to respond to all of the hall calls ahead of the car which request a service direction which corresponds with the car's travel direction. When there are no longer any calls ahead for the same service direction as the travel direction, the elevator car will respond to hall calls requesting the opposite service direction. If the elevator car had been serving up calls, for example, it will then travel to the highest down call and answer all down calls ahead of its downward travel direction.

U.S. Pat. No. 3,804,209 discloses apparatus for placing a plurality of elevator cars under group control, using a central programmable processor, with the car control of each car being similar to the car control of U.S. Pat. No. 3,750,850.

U.S. Pat. No. 3,851,733 discloses call answering strategy which may be used by the central programmable processor of U.S. Pat. No. 3,804,209.

Elevator system 10 includes a bank of elevator cars. For purposes of example, it will be assumed that the bank includes six cars A through F.

Car A includes a cab 12 and its associated car station 17. Car A is mounted in a hatchway 13 for movement relative to a structure 14 having a plurality of floors or landings. Only the lowest, next to the lowest, and the uppermost landings SB1, B2 and PH, respectively, are shown in order to simplify the drawing. Car A is supported by a plurality of wire ropes 16 which are reeved over a traction sheave 18 mounted on the shaft of a drive motor 20, such as a direct current motor as used in the Ward-Leonard drive system, or in a solid state drive system. A counterweight 22 is connected to the other end of the ropes 16.

Hall calls, as registered by pushbuttons mounted in the corridors or hallways, such as the up pushbutton 40 located at the lowest landing SB1, the down pushbutton 42 located at the uppermost landing PH, and the up and down pushbuttons 44 located at each of the intermediate landings, such as landing B2, are recorded and serialized in hall call control 46. The resulting serialized hall call information, referred to as signals $\overline{UPC}$ and $\overline{DNC}$ for serialized up and down hall calls, respectively, is directed to the system processor 11. The system processor 11, which in the incorporated U.S. Pat. Nos. 3,804,209 and 3,851,733, is a programmable system processor having a memory and operating strategy stored therein, directs the hall calls to the car controllers of the various elevator cars, along with control signals provided by the system processor to effect efficient service for the various floors of the building and effective use of the cars. The timing for controlling the serialization of all information and orderly flow thereof between the elevator cars and the system processor, is shown generally at 82.

The car control for car A includes a car controller and a floor selector, shown generally at 15. The car controller includes timing, multiplexing and demultiplexing functions, which control the communications between the car station 17 disposed in the elevator car 12, which includes pushbuttons 36 for registering car calls, floor selector, and programmable dispatcher 11.

The floor selector portion of control 15 receives signals indicative of the position of the elevator car A in the hatchway 13, and it also controls a speed pattern generator, which is also part of control 15, which generates a speed reference signal for a motor controller, also part of control 15, which in turn provides the voltage for the elevator drive motor 20.

The floor selector portion of control 15 additionally keeps track of the car A and the calls for elevator service for the car, it provides the request to accelerate signals to the speed pattern generator, and it provides the deceleration signal for the speed pattern generator at the precise time required for the elevator car to decelerate according to a predetermined deceleration schedule and stop at a predetermined floor for which a call for service has been registered. The floor selector also provides signals for controlling such auxiliary devices as the door operator and hall lanterns, and it controls the resetting of the car call and hall call controls when a car or hall call has been serviced. The up and down hall call resets, which are sent to the hall call control 46 via the system processor 11, are serialized signals which are referred to as signals $\overline{UPRZ}$ and $\overline{DNRZ}$, respectively.

The floor selector, in the absence of overriding control and/or inhibit signals from the system processor 11, includes control which enables its associated car to serve car calls placed in the car station 17, and to serve hall calls for elevator service placed at the call stations located in the hallways of the various floors. As hereinbefore stated, the incorporated U.S. Pat. No. 3,750,850 discloses a floor selector which provides the necessary operating strategy.

As disclosed in the incorporated U.S. Pat. No. 3,804,209, the programmable system processor may include a hardwired timing circuit 689, also shown in FIG. 1 of the present application, which is periodically accessed by the software program of the system processor 11. Failure of the system processor 11 to reset timer 689 before it times out indicates a malfunction in the system processor and the timer provides a low or true signal $\overline{EMT}$ which is sent to the car controllers of the various elevator cars. A true signal $\overline{EMT}$ overrides any signals the system processor 11 may be providing, to place the cars on independent operation, which is also referred to as "through trip" operation. However, as hereinbefore set forth, it is possible for the system processor 11 to malfunction in a manner such that timer 689 is reset at the proper intervals, with no dispatching, or at least ineffective dispatching, being performed by the system processor 11.

The programmable system processor 11 includes an interface function 70 for receiving signals from, and for sending signals to, the car controllers of the elevator cars in the elevator system, a core memory 72 in which a software package is stored, a processor 74 for executing instructions stored in the memory 72 relative to the dispatching of the elevator cars and otherwise for controlling the group of elevator cars according to the software strategy stored in core memory, a tape reader 76, an input interface 78 for transferring the software data from its storage form, to the core memory 72, an interrupt function 80, also connected to the processor 74 via input interface 78, and a timing function 82 for controlling the transmission of data between the system processor 11 and the car controllers of the elevator cars.

The present invention includes a new and improved dispatcher monitor 100 which is capable of timing each hall call from the time it is registered until the time it is served by an elevator car and reset. The elapsed time for each registered call is maintained in a timing table in a suitable memory. Each hall call in the timing table is successively monitored. If the hall call has not been registered for a first predetermined period of time, such as two minutes, for example, which will be referred to as a static threshold, the monitoring of the call is terminated and the dispatcher monitor goes to the next call in the timing table.

In order to accurately reflect current system traffic conditions, the timing of certain calls may be inhibited while these conditions persist, and/or the monitoring of certain calls may be terminated without making a decision relative to the operability of the dispatcher.

If the monitored hall call passes the static threshold test, and the monitoring is not terminated by a system traffic test, a dynamic threshold is established for comparison with the elapsed call time. This dynamic threshold is related to the number of in-service elevator cars which are capable of serving the hall call in question. The number of such cars may be reduced by special traffic situations. For example, if the elevator system is in an up peak traffic condition, the strategy may require a quota of two cars to be maintained at the main floor, for example. In this instance, the number of in-service elevator cars capable of serving the call in question would be reduced by this quota.

Once the final number of elevator cars which are truly capable of serving the hall call is determined, the length of time the call is allowed to be registered before the monitoring means initiates corrective action depends upon this number. For example, if six in-service elevator cars are capable of serving the call, the dynamic threshold may be the same as the static threshold. Thus, in this instance, since the time the call being considered has been registered has already passed the static threshold test, the monitoring system will immediately initiate corrective action. If no in-service elevator cars are capable of serving the call, the timer word for the call is set back to zero, and the dispatcher monitor 100 proceeds to the next call in the timing table. If the number of such cars exceeds three, for example, the dynamic threshold may be set to three minutes. If the call registration time exceeds three minutes, corrective action will be initiated. If the number of such cars is less than three but greater than zero, the dynamic threshold, for example, may be set to four minutes.

When the processing of the complete call timing table has been completed, the dispatcher monitor may make some additional tests related to main floor strategy. The call timing table, after these tests are made, is then processed again.

If the dispatcher monitor detects a malfunction, a timer is started and the dispatcher is reset. If a second malfunction is detected before the timer times out, the cars are removed from dispatcher control, with the cars being allowed to operate on the through trip strategy built into their floor selectors, as hereinbefore described.

The dispatcher monitor 100 is preferably microprocessor based, including a central processing unit (CPU) 102, such as TI's 8080, read only memories (ROM's) 104 for storing the operating program, random access memories (RAM's) 106, for storing data, such as the call timer table, a sixteen bit address bus A0–A15 on which CPU 102 places the ROM and RAM addresses via suitable buffers 108, a data bus DB0-7 connected between the ROM's 104, RAM's 106, and the CPU 102 via a bus controller 110, a clock 112 for timing the sequential operations of CPU 102 and bus controller 110, and decoders 112 and 114 for decoding certain of the address lines to provide "chip-select" signals for the ROM's 104 and RAM's 106, respectively.

Data from the system processor 11 may be obtained directly from core memory 72 via direct memory access (DMA), via a bus DMAB and buffers 116, and data may be communicated from the CPU 102 to the system processor 11 via buffers 118 and a data bus WD0-11.

The hall calls are tabulated in the DMA area of core memory 72 by the hall call control interface 70. The DMA hall call table is hardware driven and will remain accurate even when the dispatcher fails. Each word in the DMA area corresponds to one floor of the building, and it has a format as set forth in FIG. 2. For example, bit position 8 may be used to indicate hall calls associated with the front door for the down travel direction, i.e. FD. Bit position 9 may be used to indicate a hall call for the front door of the elevator car for the up travel direction, i.e. FU. Bit position 10 may be used to indicate a hall call for the rear door of the elevator car, for the down travel direction, i.e. RD. Finally, bit position 11 may be used to indicate a hall call for the rear door of the elevator car for the up travel direction, i.e. RU. A logic one in any one of these bit positions indicates a registered hall call from the associated door of the floor which corresponds to this DMA address, for the associated travel direction.

One of the ROM's 104 is programmed to indicate car-floor-service direction capability, which will be referred to as the car capability table CCT. A suitable format for table CCT is set forth in FIG. 3. In order to reduce the memory capacity required for table CCT, only the floors not severed by all cars are listed. If a floor is not listed, it is assumed that all cars can serve that floor. Thus, the up and down service directions for each door not served by all of the elevator cars has its own car capability word in table CCT. It will be assumed, for purposes of example, that a subbasement floor SB1, a basement floor B2, and a penthouse PH, are not served by all cars, and that they thus have entries to Table CCT. Each door not served by all cars has three information words in Table CCT. The first word given the floor identification by scan slot number, and it indicates whether the door is front or rear. The table is entered at a starting address and it is scanned for a match between the scan slot number of the call being processed and a scan slot number in the table. Thus, the entries in Table CCT need not be in any specific order. The end of the table is indicated by a byte having all logic ones, i.e., 1111 1111. If a match has not found by the time byte 1111 1111 is encountered during the scan, there is no entry for the door in question and it is assumed that all elevator cars have the capability of serving up and down calls at the door in question.

Figure 3:
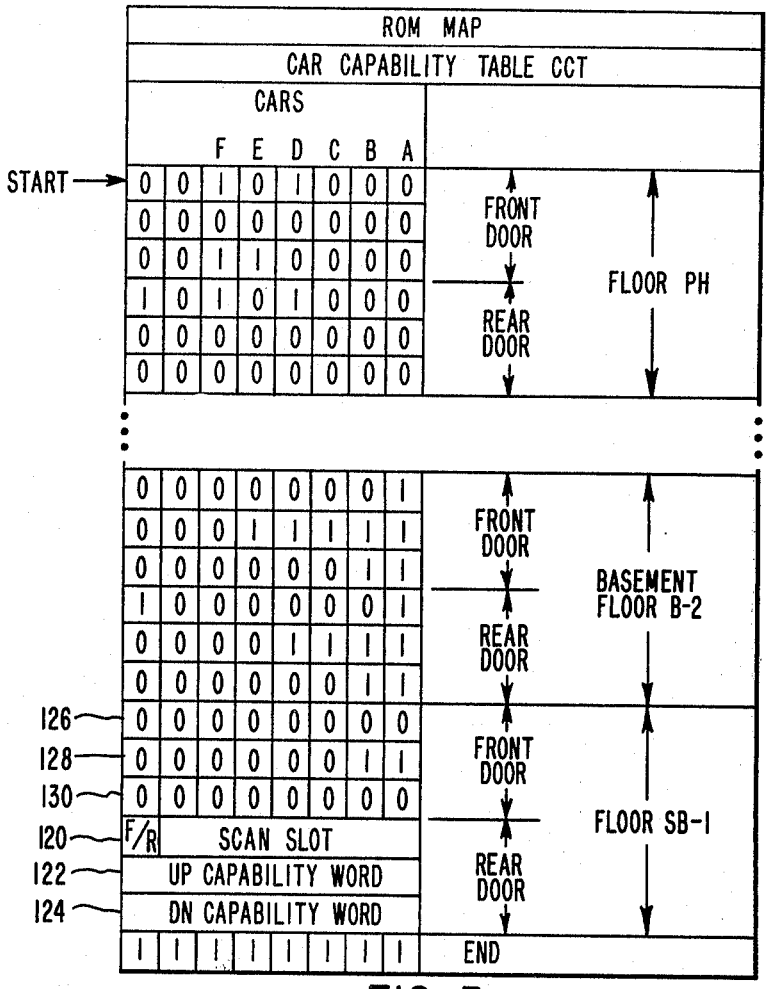
FIG. 3 is an ROM map illustrating the storage of information relative to which floors, and service directions therefrom, may be served by each elevator car of the elevator system.

More specifically, as shown in FIG. 3, subbasement floor SB1, includes first, second and third 8-bit words 120, 122 and 124, respectively, for the rear door, and first, second and third 8-bit words 126, 128 and 130 for the front door. Bit positions 0–6 of the first words 120 and 126 store the scan slot number which has been assigned to floor SB1, which may be 000000, and bit position 7 stores the door indication, with a logic one in this location indicating the rear door, and a logic zero in this location indicating the front door. Thus, word 126 will be all zeros, since the scan slot is 0000000 and since it is associated with the front door, which is indicated by a zero. Word 120 would have a logic one in bit position 7, signifying the rear door, and the remaining bits would be zeros.

The second words 128 and 122 indicate the capability of the elevator cars relative to serving the up direction from the front and rear doors of floor SB1, and the third words 130 and 124 indicate the capability of the elevator cars relative to serving the down service direction for the front and rear doors of floor SB1. The elevator cars A through F are associated with bit positions 0–5, respectively. Thus, if only two cars A and B, for example, are capable of serving the front door of floor SB1, bit positions 0 and 1 of word 128 would have logic ones, and the remaining bit position would have logic zeros. Since the lowest floor has no down service direction, words 130 and 124 would be all zeros. If floor SB1 has no rear door, word 122 would also be all zeros.

The second basement floor B2, is then set forth in table CCT. As indicated, cars A and B are capable of providing down service from floor B2 to floor SB1. For purposes of example, cars C and D, in addition to cars A and B, are shown as being able to serve the up travel direction from the rear door of floor B2, and all of the cars except car F are shown as being able to serve the up travel direction from the front door of floor B2. The scan slot assigned to floor B2 is the second scan slot 0000001.

Table CCT continues as described, setting forth the capability of the elevator cars for each door not served by all cars. In the example, it was assumed that the uppermost floor PH is not served by all cars. If floor PH is the 41st floor, its scan slot may be 0101000. Floor PH is shown with no rear door, and with only cars E and F having the capability of serving this floor. As hereinbefore stated, the end of table CCT is indicated by storing all ones in the bit positions of the word immediately after the last entry.

Figure 4:
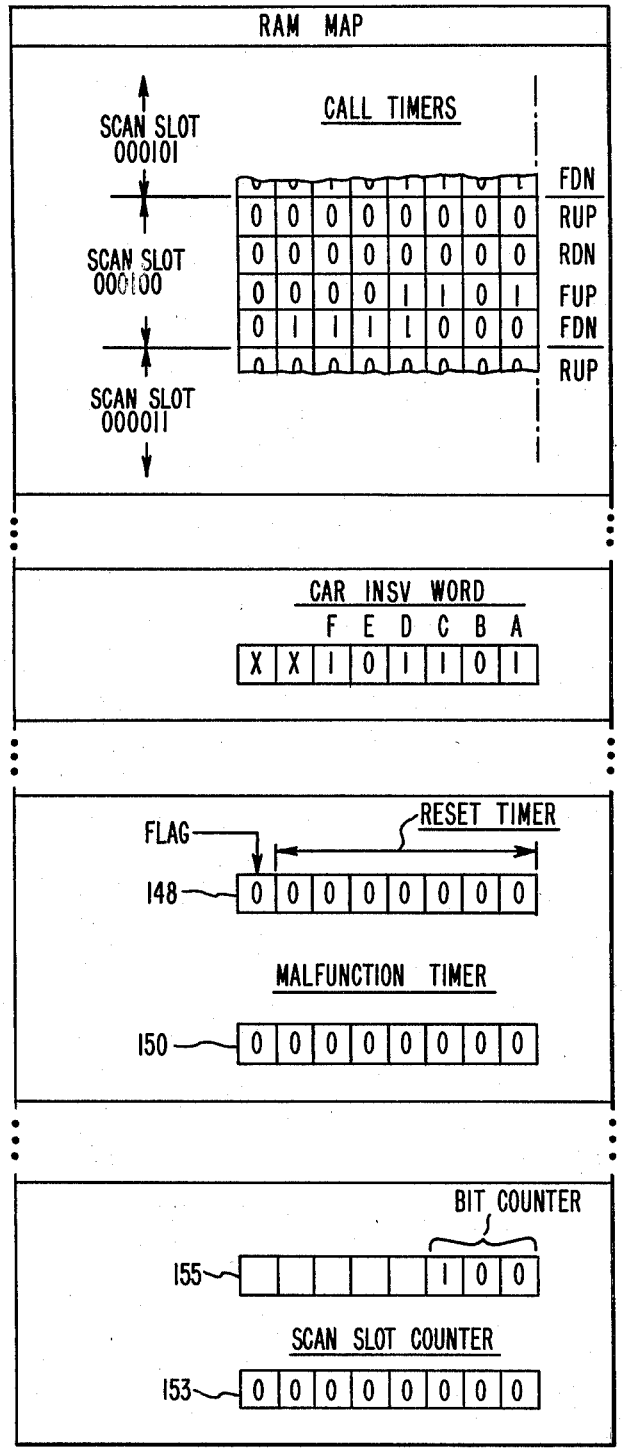
FIG. 4 is an RAM map illustrating the call timers for each service direction from each floor of the building, a car in-service word, and certain timers and counters used in the administration of the monitor program.

The hall calls registered in the DMA call storage location may be timed in one of the RAM's 106, with FIG. 4 being a RAM map setting forth a suitable format for the call timers. The timing table for the hall calls starts at a predetermined address in RAM, with each floor having four timer words associated therewith, one for each service direction from the front and rear doors. The floor associated with scan slot 000100 is shown in FIG. 4. The software timers for the rear door up and down service directions RUP and RDN, respectively, are shown zeroed, indicating no rear door at this floor, or no calls from the pushbuttons associated with the rear door. The software timers for the front door are both shown as being active, i.e. non-zero, indicating registered calls from the front door for both the up and down service directions FUP and FDN, respectively.

The RAM map of FIG. 4 additionally shows a car in-service word INSV which is updated from core memory 72 via DMA. Each car input word IWO, as described in the incorporated U.S. patents, contains the in-service information. In the example of word INSV shown in FIG. 4, cars A, C, D and F are currently in service, and cars B and E are not in service.

Figure 5A:
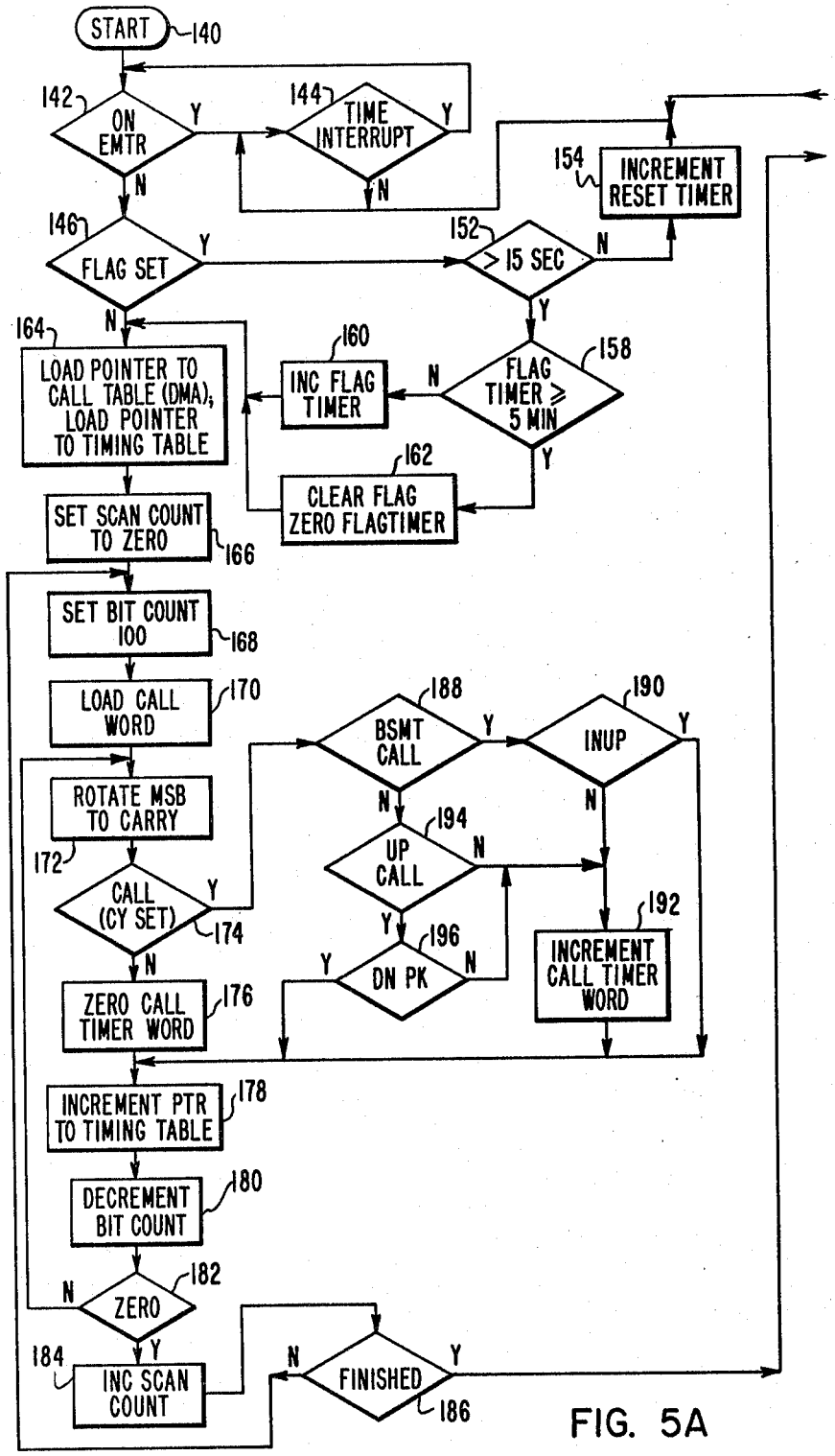
FIGS. 5A, 5B and 5C may be assembled to set forth a detailed flow chart for the operating program for the dispatcher monitor.
Figure 5B:
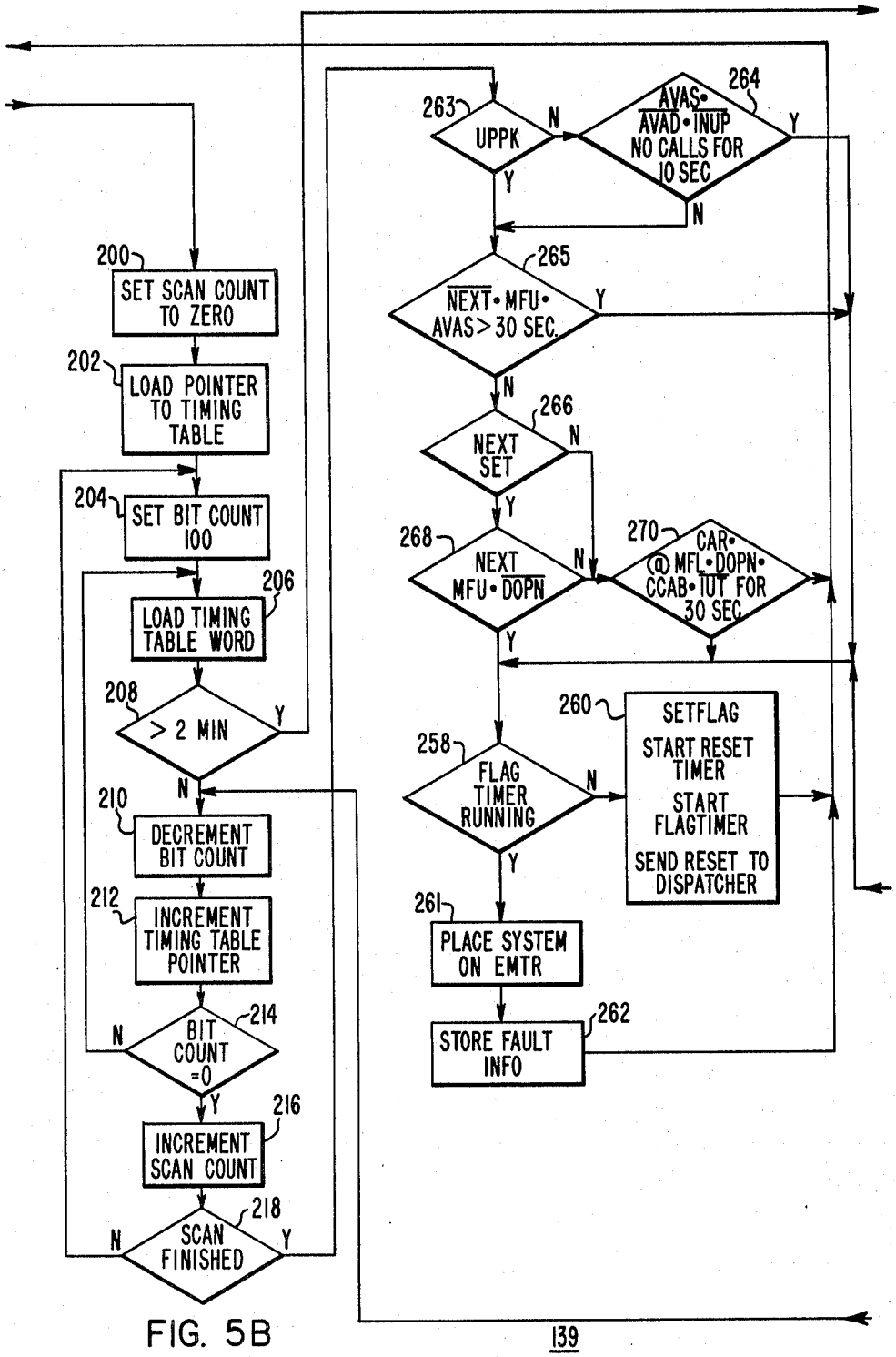
Figure 5C:
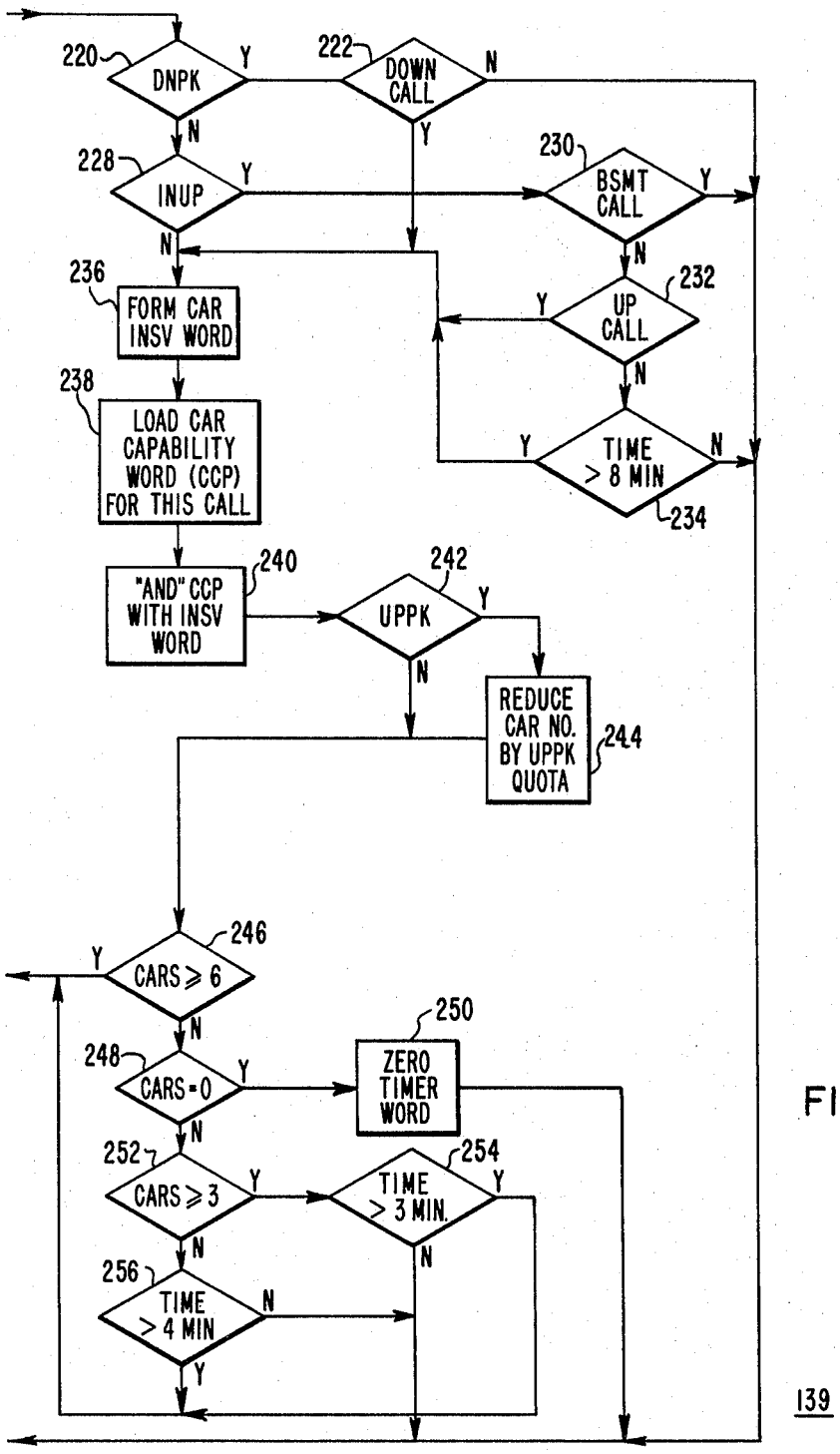

FIGS. 5A, 5B and 5C may be assembled to set forth a detailed flow chart of a program 139 which implements the teachings of the invention, and which may be used by a programmer to provide a program for storage in ROM's 104. The program starts at terminal 140 and step 142 checks to see if the system is under group supervisory control by the system processor 11, or whether it has been placed on through-trip (EMTR), in which each elevator car operates on its own strategy. If the system is on EMTR, the programs goe into a loop effected by step 144, until a hardware interrupt "frees" the program from the loop and vectors control back to the start location 140. This interrupt occurs every two seconds. Thus, all timers are the actual count times two seconds, since the program runs every two seconds. Normally, EMTR is terminated by service personnel correcting the malfunction which placed the system on EMTR. Program 139 aids service personnel by storing the fault information which initiated EMTR, which information may be printed out or viewed on a CRT.

When step 142 finds the system under group supervisory control, step 146 checks a malfunction flag in RAM's 106, such as bit position 7 of a memory word 148 shown in FIG. 4. The malfunction flag is set, as will be hereinafter described, when a malfunction is detected by monitor 100. When a malfunction is detected, a malfunction timer and a reset timer are also started in RAM's 106. The malfunction timer may be a memory word 150 shown in FIG. 4, and the reset timer may occupy bit positions 0–6 of word 148 shown in FIG. 4. The first malfunction within a predetermined period of time, such as five minutes, causes monitor 100 to initiate the resetting of the dispatcher or system processor 11, with this reset mode existing for a predetermined period of time, such as fifteen seconds. A malfunction within five minutes of a prior malfunction causes monitor 100 to place the elevator system 10 on through-trip EMTR. The malfunction flag, malfunction timer word 150, and reset timer word, bits 0–6 of word 148, are used to implement this two stage corrective action by the monitor 100. Thus, if step 146 finds the flag bit 7 of word 148 set, monitor 100 has already detected a malfunction and step 152 checks to see if the reset time in the timer word is greater than fifteen seconds. If not, the fifteen-second reset mode is still active, step 154 increments the reset timer word, and then goes into the wait loop implemented by step 144. If the reset timer indicates the reset time has expired, step 158 checks the malfunction timer word 150 to see if it is equal to or greater than five minutes. If it is not, the system is still within five minutes of a prior malfunction and step 160 increments the malfunction timer word 150. If timer word 150 has reached five minutes, step 162 clears the reset flag and zeroes the malfunction timer word 150. Once the malfunction timer word 150 reaches the preset time, a subsequent dispatcher malfunction will result in the dispatcher being reset instead of its being taken out of service.

The program advances from steps 146, 160 or 162 to step 164, which obtains hall call information from the DMA call table in core memory 72 of the system processor 11 via DMA, and it also loads a pointer to the start of the call timers in RAM's 106. This portion of the program updates the status of the call timer words, zeroing the timers of reset calls, starting the timers of certain new calls, and incrementing the timers of certain existing calls, according to a predetermined strategy.

Figure 2:
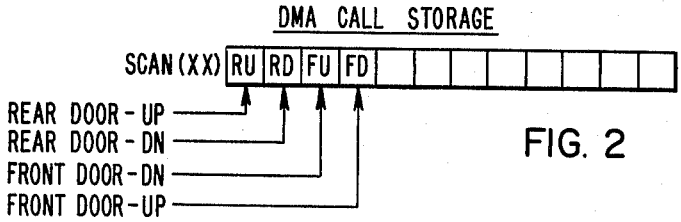
FIG. 2 graphically illustrates a call table format for a call table CL stored in RAM.

More specifically, step 166 zeroes a RAM memory word location referred to as the scan slot counter, which may be word 153 shown in FIG. 4, step 168 sets a RAM memory word location to 100 (four), such a word 155 shown in FIG. 4, because each scan slot count has four timing words associated with it, and step 170 loads the DMA call map word for the initial scan slot in the accumulator of CPU 102. Step 172 rotates the MSB to carry, where step 174 examines it for a call. The MSB, as shown in FIG. 2, indicates an up call from the rear door. If there is no rear door at this floor, or if there is no call from the rear door up pushbutton, step 176 zeroes the associated call timer word. Step 178 increments the pointer to the timing table to obtain the timer word stored at the next address. Step 180 decrements the bit count and step 182 checks to see if the bit count is zero. If it is not, the program returns to step 172 which rotates the MSB to carry, which is now the information originally stored at bit position 10. Step 174 checks to see if there is a call from the rear door for the down service direction. If there is no call, the program proceeds through steps 176 and 182, and then returns to step 172 to examine the call word for an up call for the front door. If none, steps 176 through 182 are repeated and the program returns to step 172 to check for a down call from the front door. If none, steps 176 through 182 are repeated and step 182 will now find that the bit counter has a count of zero and step 184 increments the scan count in order to check for calls at the floor associated with the next scan count number. Step 186 checks to see if the call timers for all floors have been updated. If not, the program returns to step 168, and step 170 loads the call word associated with this new scan slot into the accumulator.

When step 174 finds a call, its call timer word may be automatically incremented. In a preferred embodiment of the invention, however, whether or not the call timer is incremented is dependent upon certain traffic conditions. For example, if the call is from a basement floor, i.e. a floor below the main floor, and if the system is in an up peak (UPPK) condition, or in an intense up (INUP) condition, the basement call will not be answered as quickly as it normally would. Thus, there is no reason for a basement call of extended time to cause the monitor 100 to initiate corrective action, and thus a call from the basement is simply not timed during a traffic peak in the up direction. A car leaving the main floor in the up travel direction with more than 50% of its rated load may trigger a two-minute timer, for example, which places the elevator system in an up peak (UPPK) mode. The intense up (INUP) mode may be triggered by the system going on UPPK while a time-of-day clock indicates that the INUP feature is enabled. The INUP feature, when active, provides preferential service for a predetermined service zone above the main floor. Program CSU in the incorporated U.S. Pat. No. 3,851,733 may be used to perform these peak detection tests. Thus, when step 174 finds a call, step 188 checks to see if it is from a floor located below the main or dispatching floor. If it is, step 190 checks to see if the system is in some sort of an up traffic peak, such as UPPK or INUP. If it is not in an up traffic peak condition, step 192 increments the associated call timer word. If the system 10 is in an up traffic peak condition, step 190 bypasses step 192 and proceeds to step 178, which examines the next call timer word.

Another example where a call may not be timed is when the call is an up call and the system is in a down traffic peak condition (DNPK). When a loaded down travelling elevator car bypasses hall calls, it signifies this fact by setting a predetermined bit of a status word IWO which is sent by the car to the system processor 11. The system processor 11 then starts a down peak timer which puts the elevator system in a down peak mode for two minutes, for example. Thus, if step 188 finds the call is not from a basement or subbasement floor, step 194 checks to see if the call is an up call. If it is not an up call, step 192 increments the call timer word. If it is an up call, step 196 checks to see if the elevator system 10 is in a down peak mode. If it is not, step 192 increments the call timer word. If the system is in a down peak mode, step 196 bypasses step 192, proceeding directly to step 178 to check the next timer word.

When step 186 finds all of the timer words for all of the scan slots have been updated, the program has completed its call timer update phase and the program advances to the next phase which checks the call timer words against a static threshold value to determine if they have been registered for a period of time sufficient to merit consideration. This phase of the program starts at step 200 which zeroes the scan counter word 153 in RAM's 106. Step 202 loads the timing table pointer to the starting address of the call timer words in RAM's 106, step 104 sets the bit counter word 155 in RAM's 106 to 100 (four), and step 206 loads the timer word being addressed into the accumulator of CPU 102. Step 208 performs the static threshold function, to see if the call time has reached a magnitude which may indicate a possible dispatcher malfunction. For purposes of example, it will be assumed that the static threshold is two minutes. If the call timer word is less than this threshold, step 210 decrements the bit counter, step 212 increments the timing table pointer, and step 214 checks to see if all four timing words for the scan slot in question have been examined. If they have not been examined, the program returns to step 206 to examine the next call timer word. When all four call timer words of the scan slot under consideration have been examined, step 214 advances to step 216 which increments the scan slot counter word 153, and step 218 checks to see if all of the timing call words of all of the scan slots have been considered. If not, the program returns to step 206 to examine the timer word of the next scan slot. If step 208 finds a call timer word having a value which exceeds the static threshold value, the program advances to an examination phase which is started at step 220.

Instead of immediately developing a dynamic threshold value from the in-service word INSV shown in FIG. 4, and from the car capability table CCT shown in FIG. 3, in a preferred embodiment of the invention, certain traffic condition tests are performed to determine if the monitoring or processing of the call in question should be terminated before the call time is actually compared with a dynamic threshold value tailored for the call. For example, if the elevator system is in a down traffic peak condition, i.e. system processor 11 as set a down peak bit DNPK to a one, and the call is an up call, the monitoring of this call may be immediately terminated, as the call timer word may indicate a substantial amount of time, without the dispatcher malfunctioning in any way. Thus, step 220 may check for a system down peak, and if the DNPK is set, step 220 checks the call service direction. If the call is an up hall call, the processing of the call is terminated, and the program returns to step 210 to check the next timer word. If step 220 finds the DNPK bit a zero, the program advances to step 228. Step 228 checks to see if the elevator system is in an intense up traffic situation (INUP=1). If the INUP bit is set, it is known from steps 188 and 190 that basement calls are not being timed. Thus, step 228, upon finding an intense up traffic mode, checks to see if the call is from a floor below the main floor. If it is, step 230 returns to step 210, terminating the examination of the call. If step 230 finds the call is not from the basement, or subbasement, step 232 checks the call service direction. If the call is a down call, and since the system is in an intense up traffic mode, step 232 advances to step 234 to see if the call time exceeds some second static threshold, substantially higher than the first static threshold, such as eight minutes. If the down call timer word does not exceed eight minutes, the processing of the call is terminated, and the program returns to step 210 to examine the next timer word. If the call timer word exceeds eight minutes, processing of the call is continued.

If step 228 found bit INUP a zero, or if step 222 found that the call being considered during a down traffic peak is a down call, or if step 232 found that the call being considered during an intense up traffic condition is a non-basement up call, or if step 234 found that the call being considered during an intense up traffic condition is a non-basement down call whose timer word exceeds eight minutes, the program advances to step 236 which starts a program phase which forms a dynamic threshold value for comparison with the value of the timer word.

More specifically, step 236 checks the in-service bits of all of the elevator cars, which information is obtained from core memory 72 via DMA to develop the latest in-service information relative to which cars are currently in service. This information is stored at the memory location in RAM's 106 called the INSV word, as hereinbefore described relative to FIG. 4.

Step 236 then advances to step 238 which searches the car capability table CCT for the floor of the call being processed, obtaining this information from the table stored in RAM's 104, the format of which was hereinbefore described relative to FIG. 3. Step 240 then "ANDS" the car INSV word with the car capability word CCP to determine the number of in-service elevator cars which have the capability of providing service to the floor, door and service direction of the hall call. If no entry is found, all cars have the capability and the INSV word then represents all in-service cars with the proper capability. The number of such cars may be modified if certain system conditions "dedicate" an in-service car, or cars, to a specific assignment, which in reality makes this car, or cars, unavailable for servicing the call. For example, if the dispatcher, during an up traffic peak condition, attempts to maintain a quota of two cars at the main floor, the number of cars determined in step 240 may be reduced by two. As illustrated, these steps may be implemented by a step 242 which checks to see if the UPPK bit has been set by the system processor 11 and if it has been set, step 244 reduces the number of cars by the UPPK quota, e.g. two.

If step 242 finds the UPPK bit equal to zero, the program advances to step 246, using the number of cars determined in step 240; or, if step 242 finds the UPPK equal to one, step 244 advances to step 246 using the modified car number.

Step 246 starts the program phase which compares the dynamic threshold tailored for the call, with the actual time indicated by the call timer word, to see if the call registration time is normal under the circumstances, or abnormal. Step 246 checks to see if six or more cars, for example, are available to serve the call. If so, the dynamic threshold is the same as the static threshold, as the static threshold is set according to the maximum amount of time it should take a call to be answered when a certain number of the elevator cars of the elevator system, such as six, are in service. Since step 208 has already determined that the cell time has exceeded the static threshold, the program immediately advances to the program phase which initiates corrective action, as will be hereinafter described.

If step 246 finds less than six in-service cars capable of servicing the call, step 248 determines if there are any in-service cars capable of serving the call. If not, step 250 zeroes the timer word and the program returns to step 210 to examine the next timer word.

If step 240 finds at least one in-service elevator car capable of serving the call, step 252 checks to see if the number of in-service cars capable of serving the call is equal to three, or more. If so, step 254 determines if the timer word exceeds three minutes, for example. If it does, corrective action is taken. If it does not, the programs returns to step 210.

If step 252 finds the number of in-service cars capable of serving the call is less than three, i.e. one or two, step 256 changes the dynamic threshold to four minutes, for example. If the call timer word exceeds four minutes, the program advances to the corrective action phase. If it does not exceed four minutes, the program returns to step 210 to examine the next timer word.

As hereinbefore stated, steps 226, 254, 256, or 246, may all advance to the corrective action phase of the program, which is started by a step 258. Step 258 checks to see if the malfunction timer word 150 is active, i.e. non-zero. If it is inactive, there has been no prior dispatcher malfunction within the last five minutes, and the program goes into the first stage of its corrective action via step 260. Step 260 sets the malfunction flag to a logic one (bit position 7 of word 148 in FIG. 4), it starts (zeros) the reset timer (bit 0–6 of word 148), it starts (zeros) the malfunction timer word 150, and it sends a reset signal to the dispatcher or system processor 11. Step 260 then returns to step 144 to start a loop which includes steps 142, 146, 152 and 154, which is repeated until the fifteen second reset time has expired which enables the system processor 11 to re-initiate and start again.

If step 258 finds the malfunction timer word 150 non-zero, there has been a prior malfunction of the dispatcher within the past five minutes, and step 258 proceeds to step 261. Step 261 sends a signal EMTR to the system processor 11 which is multiplexed into the command words sent to the cars without going through the core memory 72 or through the processor 74. When the cars receive signal EMTR, call command words from the system processor 11 are ignored, placing each elevator car on its own through-trip strategy.

Step 262 stores the information which was detected as indicating a dispatcher malfunction, for use by service personnel, and then step 262 returns to the wait loop, i.e. step 144.

When step 218 finds that all of the call timer words of all of the scan slots have been processed, instead of immediately starting to process the call timer words again, the monitor 100 makes several other checks to compare certain inputs to the system processor 11 with certain of its outputs, in order to determine if the system processor 11 is responding properly to these inputs. For example, step 218 may advance to step 263 to see if the system is in an up traffic peak condition, e.g. the system processor has set a bit UPPK to a one. If step 263 finds bit UPPK a zero, step 264 checks to see if the dispatcher is correctly making idle cars available for special assignment. When a car becomes available for assignment according to its own floor selector, it sends a true signal AVAS to the dispatcher or processor 11. Even though the car is available for assignment at the floor selector level, however, the dispatcher or processor 11 may not make the car available for assignment at the dispatcher level during certain traffic peak conditions. For example, it may place the car into a main floor quota during an up traffic peak condition. If there are no traffic peaks, and no hall calls for a predetermined period of time, however, a proper functioning dispatcher will make a car which is available for assignment at the floor selector level, available for assignment at the dispatcher level by setting a bit AVAD. Thus, step 263 may advance to a step 264 which checks to see if there is an available car at the floor selector level (AVAS=1), there are no up traffic peaks (INUP=0, step 263 has already determined that UPPK is zero), there have been no hall calls for ten seconds, and still the dispatcher has not made a car available at the dispatcher level (AVAD=0). If step 264 finds all of these conditions, this indicates a dispatcher malfunction, and the program advances to the program phase which initiates corrective action, i.e. to step 258.

If step 264 does not find all of these conditions, step 264 advances to step 265 which checks certain functions associated with the main or dispatching floor. For example, if there is an up call registered at the main floor (MFU=1), and a car is available for assignment at the selector level (AVAS=1) for a predetermined period of time, the dispatcher should select a car as the next car to leave the main floor by setting a bit NEXT in the command word for the car (bit position 10 of word OW2 in the incorporated U.S. Pat. No. 3,804,209). Step 264 checks these conditions, and if there is no car designated as the next car, and there is an up call registered at the main floor, and a car has been available at the selector level for at least thirty seconds, the program goes to the malfunction phase started by step 258. If step 264 does not find the combination of conditions tested, it advances to step 266 and checks to see if the dispatcher has selected a car as the next car to leave the main floor. If it has made such a selection (NEXT=1), and there is an up call registered from the main floor (MFU=1) the dispatcher should provide a door open command for the car (DOPN=1). Step 268 checks this combination. If the dispatcher has not issued a door open command when the tested conditions are true, the dispatcher has malfunctioned and step 268 goes to the malfunction phase of the program.

If step 268 does not detect a malfunction in the tested combination, it advances to step 270 to check still another combination. Step 266 also advances to step 270 if it finds no car selected as the next car to leave the main floor. Step 270 tests the combination in which a car is located at the main floor with its doors open and a car call has been registered in the car for a floor above the main floor, and this situation has existed for thirty seconds, during which time the system has not been in the intense up traffic mode on "intense up" (INUP=1), a car call above may not warrant dispatching the car if the call is not for the INUP service zone. If the system is not in the INUP mode, however, there is no reason why the car should not be dispatched. If step 270 finds this combination, the dispatcher has malfunctioned and step 270 goes to step 258. If it does not find this combination, step 220 returns to step 144, to await the next time interrupt, and it then processes the whole program again.

We claim as our invention:

1. An elevator system for serving calls for elevator service in a building having a plurality of floors, comprising:

a plurality of elevator cars;

call means for registering calls for elevator service, means for timing at least certain of the calls for elevator service from registration until service thereof, dispatcher means for distributing the calls for elevator service among the in-service elevator cars according to a predetermined group operating strategy, and monitoring means for monitoring the calls for elevator service to detect a malfunction of said dispatcher means, said monitoring means including means for determining a dynamic threshold value for at least certain of the monitored calls, with said threshold value being responsive to at least one predetermined system parameter, said monitoring means initiating a predetermined corrective modification of the elevator system in response to the call registration time of a monitored call exceeding the determined dynamic threshold value for the call.

2. The elevator system of claim 1 wherein the predetermined corrective action includes resetting the dispatcher means.

3. The elevator system of claim 1 wherein the predetermined corrective action includes removing the plurality of elevator cars from group control by the dispatcher means.

4. The elevator system of claim 1 wherein the predetermined action includes resetting the dispatcher for a malfunction which occurs more than a predetermined period of time after any preceding malfunction, and removing the elevator cars from group control by the dispatcher means for a malfunction which occurs within said predetermined period of time of a previous detection of a malfunction.

5. The elevator system of claim 1 wherein the at least one predetermined system parameter includes the number of in-service elevator cars which have the capability of serving the call.

6. The elevator system of claim 1 wherein the at least one predetermined system parameter is related to a predetermined traffic condition.

7. The elevator system of claim 1 wherein the at least one predetermined system parameter is related to call service direction, and including an additional parameter related to a predetermined traffic peak condition.

8. The elevator system of claim 1 wherein the monitoring means includes a static threshold value which must be exceeded by a call registration time before the dynamic threshold value for a monitored call is determined.

9. The elevator system of claim 1 wherein each registered call is successively monitored, and including means terminating the monitoring of a call whose registration time does not exceed a predetermined static threshold value.

10. The elevator system of claim 9 wherein the monitoring of a call registered from at least one floor is terminated during a predetermined peak traffic condition.

11. The elevator system of claim 10 wherein the at least one floor is a basement floor and the predetermined peak traffic condition is related to the up traffic direction.

12. The elevator system of claim 9 wherein the monitoring of a call registered for a predetermined service direction is terminated during a predetermined peak traffic condition.

13. The elevator system of claim 12 wherein the predetermined service direction is the up service direction, and the predetermined peak traffic condition is related to the down traffic direction.

14. The elevator system of claim 9 wherein the monitoring of a call registered for a predetermined service direction is terminated during a predetermined peak traffic condition, unless the registered time exceeds a second predetermined static threshold level.

15. The elevator system of claim 14 wherein the predetermined service direction is the down service direction, and the predetermined peak traffic condition is related to the up traffic direction.

16. The elevator system of claim 1 wherein the at least one predetermined system parameter is the number of in-service elevator cars having the capability of serving the call, with the call registration time being set to zero for a call in which there are no in-service elevator cars capable of serving the call.

17. The elevator system of claim 1 wherein each registered call is successively monitored, with the monitoring being terminated for a call whose registration time does not exceed a predetermined static threshold value, and wherein the at least one system parameter is the number of in-service elevator cars having the capability of serving the call, with the dynamic threshold value being set to the static threshold value when the number of in-service calls capable of serving the call exceeds a predetermined number.

18. The elevator system of claim 17 wherein the dynamic threshold value is increased in steps responsive to the number of in-service elevator cars capable of serving the call.

19. The elevator system of claim 1 wherein each call is successively monitored in a predetermined sequence, with the sequence being repeated at predetermined intervals.

20. The elevator system of claim 1 wherein the monitoring means includes means for checking the response of the dispatcher means to a predetermined combination of system conditions, with the monitoring means performing such checks in the intervals between the sequential monitoring of the calls, with the predetermined corrective modification being initiated in response to an improper response of the dispatcher to the predetermined combination of system conditions.

21. The elevator system of claim 20 including a main floor in the building for which the dispatcher means selects an elevator car as the next car to leave the main floor, with the predetermined combination of system conditions which will cause the monitoring means to initiate the corrective action being:

(a) no elevator car selected as the next car to leave the main floor,
(b) a call registered from the call means at the main floor,
(c) the existence of an in-service elevator car available to be assigned by the dispatcher means to the main floor call, and
(d) the existence of the available car for more than a predetermined period of time.

22. The elevator system of claim 20 including a main floor in the building for which the dispatcher means selects an elevator car as the next car to leave the main floor, with the predetermined combination of system conditions which will cause the monitoring means to initiate the corrective action being:

(a) an elevator car selected by the dispatcher to be the next car to leave the main floor,
(b) a call registered from the call means at the main floor, and
(c) the selected car is parked with its doors closed.

23. The elevator system of claim 20 including a main floor in the building for which the dispatcher means selects an elevator car as the next car to leave the main floor, with the predetermined combination of system conditions which will cause the monitoring means to initiate the corrective action being:

(a) an elevator car is at the main floor with its doors open,
(b) a car call for the up service direction has been registered in the elevator car, and
(c) a predetermined period of time expires during which there has been no peak traffic condition associated with the up service direction.

24. The elevator system of claim 1 wherein each elevator car includes a floor selector which provides a signal indicating it is available for assignment in response to predetermined conditions, the dispatcher means includes means for determining which of the cars signified as being available by a floor selector is available for assignment, and wherein each registered call is successively monitored, with the monitoring being terminated for a call whose registration time is less than a predetermined static threshold, and further including means for detecting traffic peaks, and wherein the monitoring means initiates the predetermined corrective modification for a call which exceeds said static threshold, if the traffic peak detecting means detects no traffic peaks in the up travel direction, there is at least one elevator car available for assignment at the floor selector level, there have been no calls registered within a predetermined period of time, and the dispatcher means has not made any car available for assignment at the dispatcher level.

25. The elevator system of claim 1 including means for indicating the existence of at least one predetermined traffic peak condition, and means responsive to the existence of said at least one predetermined traffic peak condition for preventing the timing of predetermined calls which receive less elevator service during the existence of such a traffic peak.

26. The elevator system of claim 25 wherein the building has a main floor, and the at least one predetermined traffic peak condition is related to the up service traffic direction from the main floor, with the predetermined calls which are not timed being calls registered from floors located below the main floor.

27. The elevator system of claim 25 wherein the building has a main floor, and the at least one predetermined traffic peak condition is related to the down service direction, with the predetermined calls which are not timed being calls registered from floors above the main floor which request the up service direction.

28. The elevator system of claim 1 including means for indicating the existence of at least one predetermined traffic peak condition, with said dispatcher means, in response to the existence of said at least traffic peak condition, attempting to maintain a predetermined quota of elevator cars to serve said traffic peak condition, and wherein the at least predetermined system parameter is the number of in-service elevator cars having the capability of serving the call, with the monitoring means reducing this number by said quota during the existence of said at least one predetermined traffic condition.

* * * * *